US006941769B1

(12) United States Patent
Hill, IV et al.

(10) Patent No.: US 6,941,769 B1
(45) Date of Patent: Sep. 13, 2005

(54) FLASH TANK ECONOMIZER REFRIGERATION SYSTEMS

(75) Inventors: Frank Highland Hill, IV, York, PA (US); Curtis Christian Crane, York, PA (US); Michael Lee Buckley, Abbottstown, PA (US); Blake Evan Stabley, York, PA (US)

(73) Assignee: York International Corporation, York, PA (US)

( * ) Notice: Subject to any disclaimer, the term of this patent is extended or adjusted under 35 U.S.C. 154(b) by 89 days.

(21) Appl. No.: 10/820,304

(22) Filed: Apr. 8, 2004

(51) Int. Cl.[7] ..... F25B 43/00

(52) U.S. Cl. ..... 62/512; 62/509; 62/512; 62/513; 62/518

(58) Field of Search ..... 62/512, 509, 513, 62/518

(56) References Cited

U.S. PATENT DOCUMENTS

| | | | | |
|---|---|---|---|---|
| 2,512,869 | A | 6/1950 | McBroom | |
| 2,859,596 | A | 11/1958 | Evans | |
| 2,986,903 | A | 6/1961 | Kocher et al. | |
| 3,192,735 | A | 7/1965 | Bernhard | |
| 3,232,074 | A | 2/1966 | Weller et al. | |
| 4,059,968 | A * | 11/1977 | Ross | 62/174 |
| 4,232,533 | A | 11/1980 | Lundblad et al. | |
| 4,330,307 | A * | 5/1982 | Coury | 62/618 |
| 4,466,253 | A | 8/1984 | Jaster | |
| 4,899,555 | A | 2/1990 | Shaw | |
| 5,189,885 | A * | 3/1993 | Ni | 62/117 |
| 5,603,227 | A | 2/1997 | Holden et al. | |
| 5,692,389 | A | 12/1997 | Lord et al. | |
| 5,829,265 | A | 11/1998 | Lord et al. | |
| 6,434,960 | B1 | 8/2002 | Rousseau | |
| 6,438,972 | B1 | 8/2002 | Pickett, Jr. et al. | |
| 6,481,241 | B1 | 11/2002 | Fisk et al. | |

* cited by examiner

*Primary Examiner*—Melvin Jones
(74) *Attorney, Agent, or Firm*—McNees Wallace & Nurick LLC

(57) ABSTRACT

A flash tank configuration for an economizer is provided that is inexpensive and simple to construct, reliable to operate, and efficient for use in an economizer compression refrigeration system. The configuration includes an upper baffle and a lower baffle configured and arranged within the flash tank so as to separate the liquid and gas phases of intermediate pressure refrigerant, and to convey each phase to other components in the refrigeration systems. The flash tank has a generally cylindrical shape, and is dimensioned so as to provide adequate internal volume for expansion of refrigerant to a desired pressure, separation of the resulting refrigerant gas and refrigerant liquid phases, and temporary storage of the refrigerant phases before conveying the liquid phase to the main refrigerant line between the condenser and the evaporator, and returning the gas phase to the compressor. Additionally, methods are provided for using the flash tank to separate refrigerant phases.

27 Claims, 10 Drawing Sheets

FLASH TANK ECONOMIZER REFRIGERATION SYSTEMS

BACKGROUND OF THE INVENTION

This invention relates to capacity and efficiency control of refrigeration systems, and in particular, to a flash tank economizer for enhancing the performance of a refrigeration system. As will be explained below, the present invention involves a novel configuration of a flash tank economizer configuration that utilizes a system of internal baffles to produce expansion of refrigerant liquid, separation of the resulting refrigerant gas from the remaining refrigerant liquid, and temporary storage of both the refrigerant gas and liquid before conveying them to other components of the refrigeration system.

A typical compression refrigeration system is composed of the following components: an evaporator for exchanging heat between a medium to be cooled and a refrigerant; a compressor that takes the low-pressure gas refrigerant generated in the evaporator and compresses the gas to a suitable higher pressure; a condenser that facilitates the heat exchange between the high-pressure refrigerant and another fluid (such as ambient air or water) resulting in conversion of the high pressure gas to high pressure liquid; an expansion device for receiving high pressure liquid from the condenser and expanding the liquid to yield low pressure liquid and some low pressure refrigerant gas; and biphasic piping connecting the expansion device to an evaporator.

In addition to the basic components described above, the refrigeration system can also include other components intended to improve the thermodynamic efficiency or performance of the system. In the case of a multiple stage compression system, and also with screw compressors, an "economizer" circuit may be included to improve the efficiency of the system and for capacity control. Economizer circuits are utilized in compression refrigeration systems to provide increased cooling or heating capacity. Such use of economizer circuits is well known within the art.

One type of economizer circuit involves drawing of refrigerant gas from an intermediate pressure stage of the compression cycle to reduce the amount of gas compressed in the next compression stage, thus increasing efficiency of the motor during the next compression stage. The medium-pressure gas is typically returned to suction or to an intermediate compression stage, where it may slightly increase the pressure of suction gas flowing to the compressor, further reducing the amount of compression required by the compressor.

Another type of economizer circuit increases system capacity and efficiency by drawing some high pressure refrigerant from the condenser, routing the drawn refrigerant through an expansion device to lower the pressure and temperature of the refrigerant, and returning the resulting intermediate-pressure refrigerant to various points in the refrigeration circuit. This second type of economizer circuit is customarily incorporated in the high-pressure flow line just downstream of the condenser. A portion of the refrigerant leaving the condenser is tapped from the main flow line, and is passed through an economizer expansion device. An economizer heat exchanger, such as a flash tank, receives the refrigerant leaving the economizer expansion device. Within the flash tank, a portion of the refrigerant expands to form intermediate pressure gas, and the remainder of the refrigerant is converted to an intermediate pressure liquid phase. The intermediate pressure gas phase is returned to the compressor, preferably at an intermediate compression stage of a multiple stage compressor, where it will require less compression to reach a pre-selected pressure, thus increasing compressor efficiency. The intermediate pressure liquid phase is returned from the flash tank to the main flow line at a point before the main flow enters the primary expansion device leading to an evaporator. Upon entry into the main flow line, the intermediate pressure liquid refrigerant from the economizer circuit expansion device cools the main flow of refrigerant. Because the refrigerant reaching the primary expansion device has been pre-cooled, greater cooling capacity of the evaporator is achieved.

Known flash tanks for use in economizer circuits are relatively complex structures. For example, known flash tanks have complex arrangements of internal baffles, floats, phase separation screens, and other components. For example, the flash tanks shown and described in U.S. Pat. No. 5,692,389 and U.S. Pat. No. 4,232,533 include complex arrangements of chambers, floats, wire screens, baffles, sleeves, and demister filters. Such complex arrangements are expensive and time-consuming to manufacture, maintain, and repair.

Therefore, what is needed is a flash tank having a relatively simple internal configuration and arrangement of components that can provide excellent refrigerant expansion and phase separation.

SUMMARY OF THE INVENTION

A flash tank is provided for use in an economizer circuit, the flash tank including a housing having a substantially cylindrical shape with substantially straight sidewalls. The housing includes an upper shell section, a middle shell section, and a lower shell section, each section having a substantially cylindrical sidewall, each sidewall forming at least one opening for connection to an opening in another section. Each shell section includes an opening having a substantially circular horizontal cross-sectional geometry. The upper shell section includes a refrigeration inlet located in the sidewall, and a substantially cylindrical baffle having a sidewall disposed substantially parallel to the sidewall of the upper section. The baffle sidewall is disposed opposite the refrigeration inlet for receiving and directing the flow of high-pressure refrigerant introduced into the housing through the refrigeration inlet. The upper shell section further includes a gas outlet located in the closed end portion and disposed opposite the opening of the upper section. The middle shell section includes a second baffle located on the interior side of the sidewall, and further incuse a liquid level control apparatus mounted through the sidewall. The lower shell section includes a liquid refrigerant outlet located in the sidewall for conveying liquid refrigerant from the housing to another component in a refrigeration system.

A method is provided for separating liquid refrigerant from refrigerant gas in an economizer refrigeration system. The method includes the steps of: providing a refrigeration system equipped with an economizer circuit, the economizer circuit including a flash tank having a housing with a refrigerant inlet, a refrigerant gas outlet, a liquid refrigerant outlet, a cylindrical baffle, and a second baffle; collecting liquid refrigerant in a condenser of the refrigeration system; passing the liquid refrigerant from the condenser to a liquid refrigerant line of the economizer circuit, the refrigerant line having an expansion device therein and communicably connected to the refrigerant inlet of a flash tank; receiving expanding refrigerant from the liquid line into the refrigerant inlet; directing the flow of received refrigerant against the cylindrical baffle of the flash tank, the cylindrical baffle located substantially opposite the refrigerant inlet; separating the gas phase of the liquid refrigerant from the liquid phase of the refrigerant; and preventing re-entrainment of refrigerant gas by providing a second baffle located on the sidewall of the housing at a point above a preselected maximum liquid level.

One advantage of the present invention is improved operation and performance of a compression refrigeration system.

Another advantage of the present invention is that it has a simple construction that can operate reliably and efficiently in a refrigeration system, and yet is inexpensive and simple to construct and install in a compression refrigeration system having an economizer circuit.

Still another advantage of the present invention is that it provides efficient expansion of the high-pressure refrigerant moving between the condenser and the evaporator of a compression refrigeration system.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

The subject matter of the invention under consideration is directed to a system and process for improving the efficiency and capacity of a refrigeration system employing an economizer. The system and process can be used with any type of compressor, but is particularly suited for use with screw compressors, since screw compressors can easily incorporate economizers.

Figure 1:
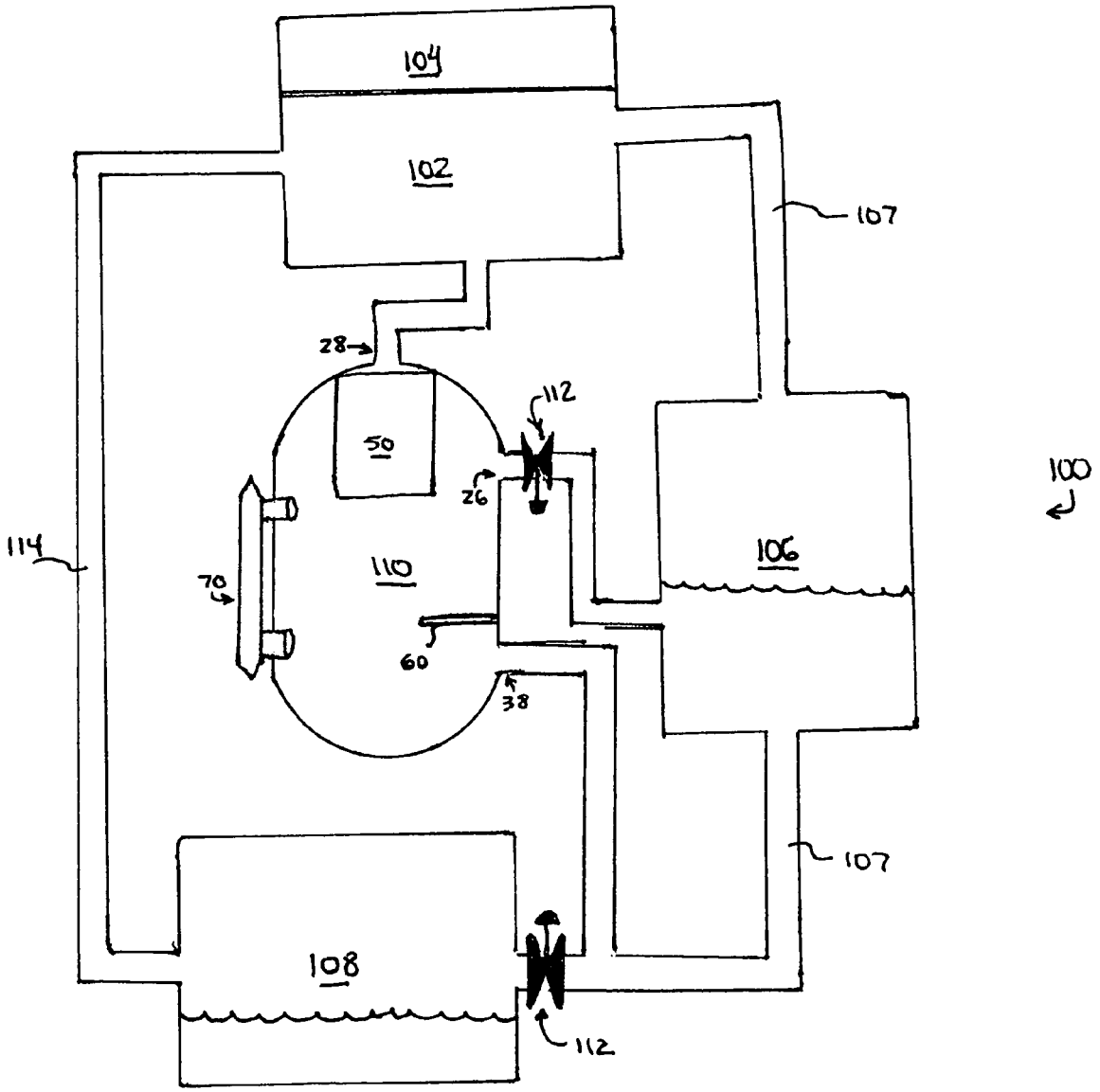
FIG. 1 is a system diagram illustrating the components of a refrigeration circuit in accordance with the present invention.

Referring initially to FIG. 1, there is shown a conventional refrigeration system 100 incorporating an economizer circuit in accordance with the present invention. As shown, refrigeration system 100 includes a compressor 102, a motor 104, a condenser 106, an evaporator 108, and an economizer flash tank 110. The conventional refrigeration system 100 includes many other features that are not shown in FIG. 1. These features have been purposely omitted to simplify the drawing for ease of illustration.

Compressor 102 compresses a refrigerant vapor and delivers the vapor to the condenser 106 through a discharge line. The compressor 102 is preferably a screw compressor or other multiple-stage compressor. Although a screw compressor is ideally suited for use in the present compact refrigeration system, the invention is not restricted to a single type of compressor and other types of compressors, such as centrifugal compressors, may be similarly employed in the practice of the subject invention. To drive the compressor 102, the system 100 includes a motor or drive mechanism 104 for compressor 102. While the term "motor" is used with respect to the drive mechanism for the compressor 102, it is to be understood that the term "motor" is not limited to a motor but is intended to encompass any component that can be used in conjunction with the driving of motor 104, such as a variable speed drive and a motor starter. The motor 104 can be an induction motor or a high-speed synchronous permanent magnet motor. Alternative drive mechanisms such as steam or gas turbines or engines and associated components can also be used to drive the compressor 102. In a preferred embodiment of the present invention, the motor 104 is an electric motor and associated components.

The refrigerant vapor delivered by the compressor 102 to the condenser 106 through the discharge line enters into a heat exchange relationship with a fluid, e.g., air or water, and undergoes a phase change to a refrigerant liquid as a result of the heat exchange relationship with the fluid. In one embodiment, a portion of the condensed refrigerant liquid is diverted to an economizer circuit. In an alternative embodiment, the economizer circuit forms the sole connection between the condenser and the evaporator, and all condensed refrigerant is diverted through the economizer circuit. In either embodiment, the economizer circuit includes a refrigerant line that draws refrigerant from the condenser and conveys it to an expansion device 112 connected to a flash tank 110. The condensed liquid refrigerant passes through the expansion device 112 and into the flash tank 110 where a portion of the refrigerant expands and is converted to intermediate pressure gas, the remaining refrigerant staying in liquid state or phase at intermediate pressure. The intermediate pressure gas is drawn through a gas outlet 28 to an intermediate stage of the compressor 102. The intermediate pressure liquid is returned from the flash tank 110 to the main line 107 connecting the condenser 106 to an expansion valve 112 leading to the evaporator 108. In one embodiment, the refrigerant vapor in the condenser 106 enters into the heat exchange relationship with fluid flowing through a heat-exchanger coil (not shown). In any event, the refrigerant vapor in the condenser 106 undergoes a phase change to a refrigerant liquid as a result of the heat exchange relationship with the fluid.

The evaporator 108 can be of any known type. For example, the evaporator 108 may include a heat-exchanger coil (not shown) having a supply line and a return line connected to a cooling load. The heat-exchanger coil can include a plurality of tube bundles within the evaporator 108. A secondary liquid, which is preferably water, but can be any other suitable secondary liquid, e.g., ethylene, calcium chloride brine or sodium chloride brine, travels in the heat-exchanger coil into the evaporator 108 via a return line and exits the evaporator via a supply line. The refrigerant liquid in the evaporator 108 enters into a heat exchange relationship with the secondary liquid in the heat-exchanger coil to chill the temperature of the secondary liquid in the heat-exchanger coil. The refrigerant liquid in the evaporator 108 undergoes a phase change to a refrigerant vapor as a result of the heat exchange relationship with the secondary liquid in the heat-exchanger coil. The low-pressure gas refrigerant in the evaporator 108 exits the evaporator 108 and returns to the compressor 102 by a suction pipe 114 to complete the cycle.

While the system 100 has been described in terms of preferred embodiments for the compressor 102, motor 104, condenser 106, and evaporator 108, it is to be understood that any suitable configuration of those components can be used in the system 100, provided that the appropriate phase change of the refrigerant in the condenser 106 and evaporator 108 is obtained.

In the embodiment of FIG. 1, the economizer circuit of the present invention is comprised of a flash tank 110 communicably connected to the high-pressure refrigerant line 107 between the condenser 106 and the expansion device 112. The flash tank 110 of the present invention preferably has a generally cylindrical shape, and is dimensioned so as to provide adequate internal volume for expansion of refrigerant to a desired pressure, separation of the resulting refrigerant gas and refrigerant liquid phases, and temporary storage of the refrigerant phases before conveying the liquid phase to the main refrigerant line 107, and conveying the gas phase to the compressor 102. The desired dimensions, such as height, width, and internal volume of the tank depend upon factors such as refrigerant type, compressor displacement, desired system capacity, capacity of refrigerant lines and other refrigeration system components, and other factors known to those skilled in the art.

Figure 2:
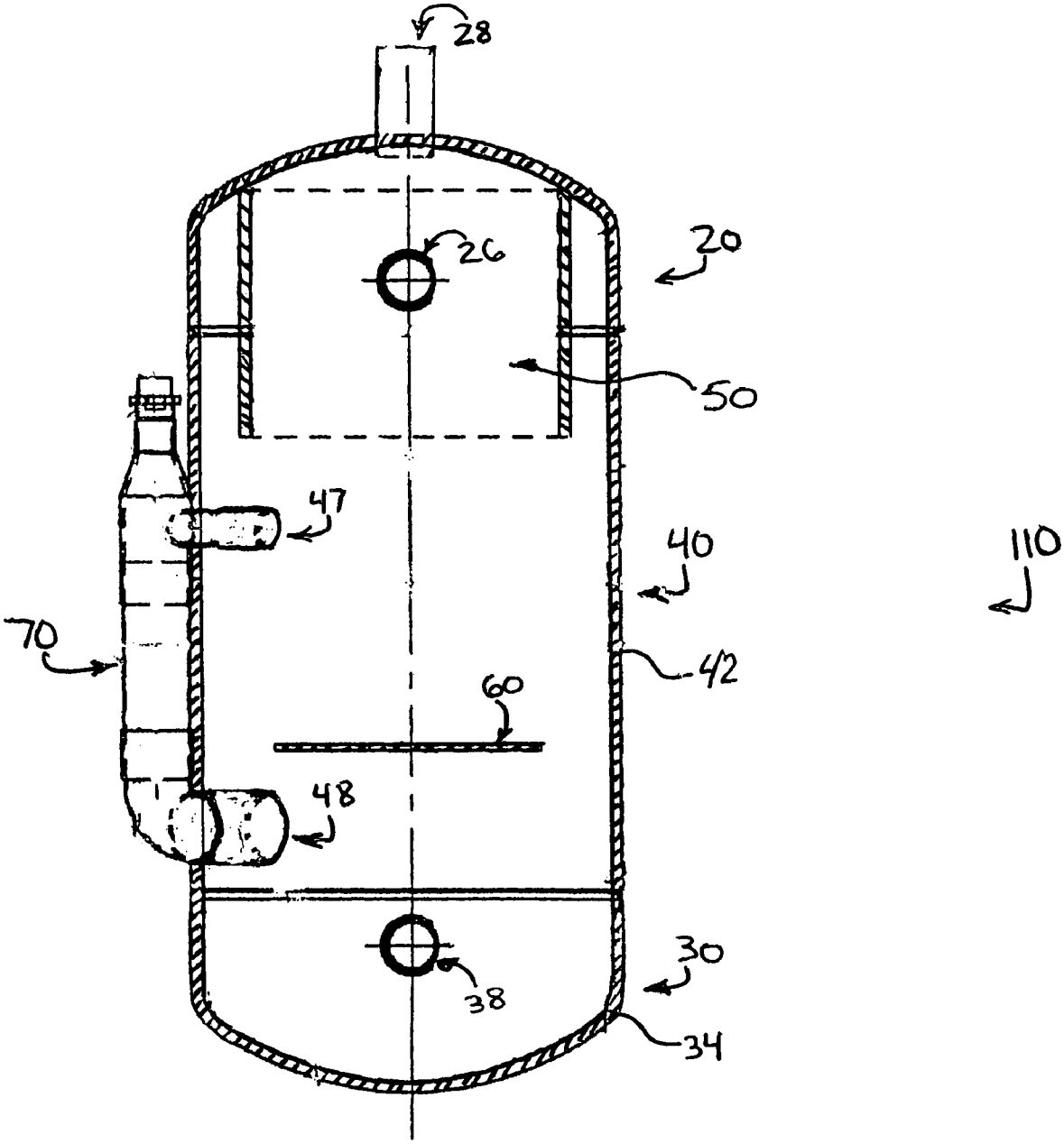
FIG. 2 is a vertical side cross-sectional view of a flash tank economizer in accordance with the present invention.

FIG. 2 illustrates one embodiment of the flash tank 110 of the present invention. In this embodiment, the flash tank 110 of the present invention includes a housing comprised of three shell sections, an upper shell section 20 and a lower shell section 30 that are connected by a middle shell section 40 to form a generally cylindrical housing. Each section 20, 30, 40 is preferably formed by a metal drawing operation from low carbon sheet steel of a substantially uniform thickness, preferably from about 0.375 to about 0.500 in. However, it is to be understood that the sections 20, 30, 40 can be formed by any suitable process and can have any suitable thickness.

Figure 3:
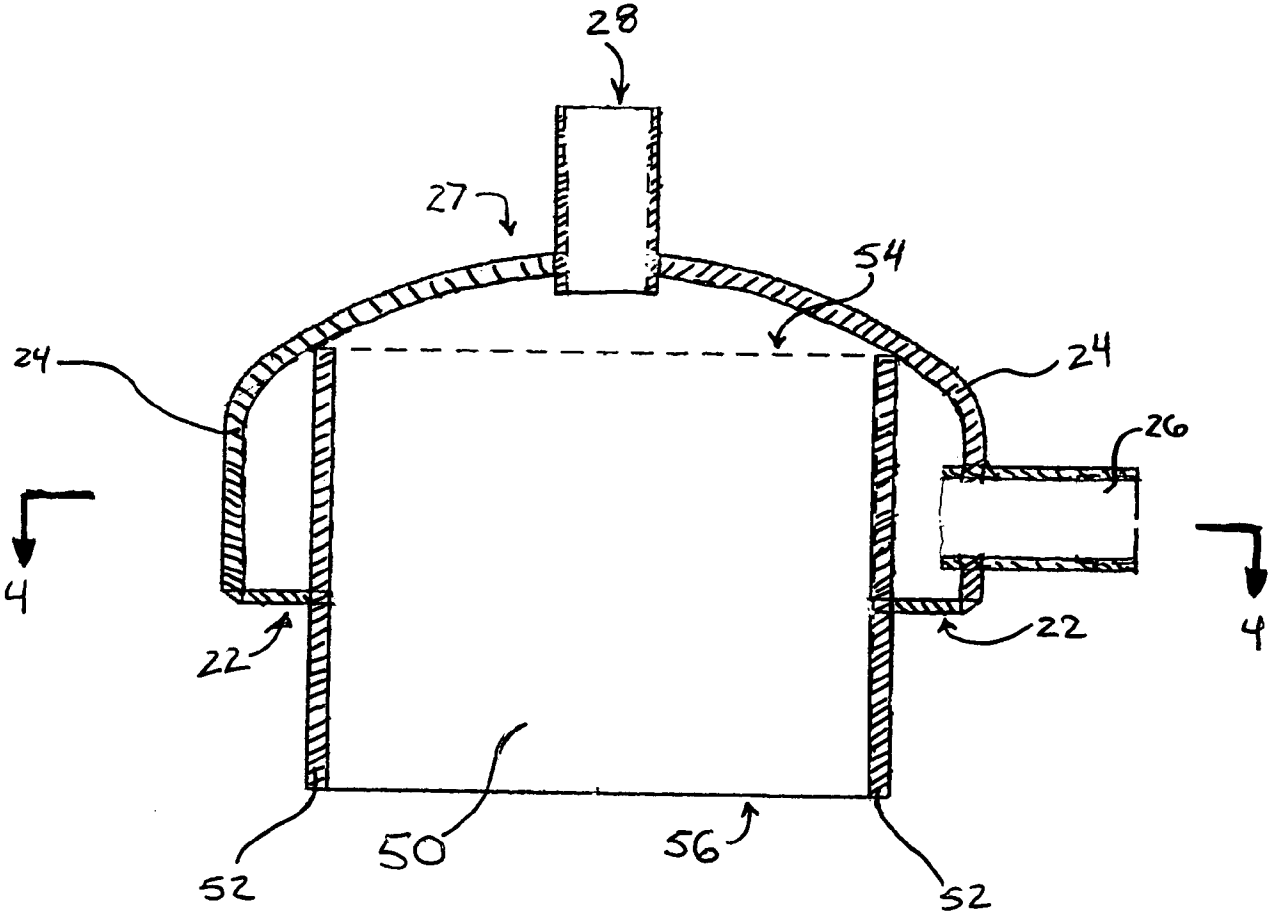
FIG. 3 is a vertical side cross-sectional view of an upper shell section of a flash tank economizer in accordance with the present invention.
Figure 8:
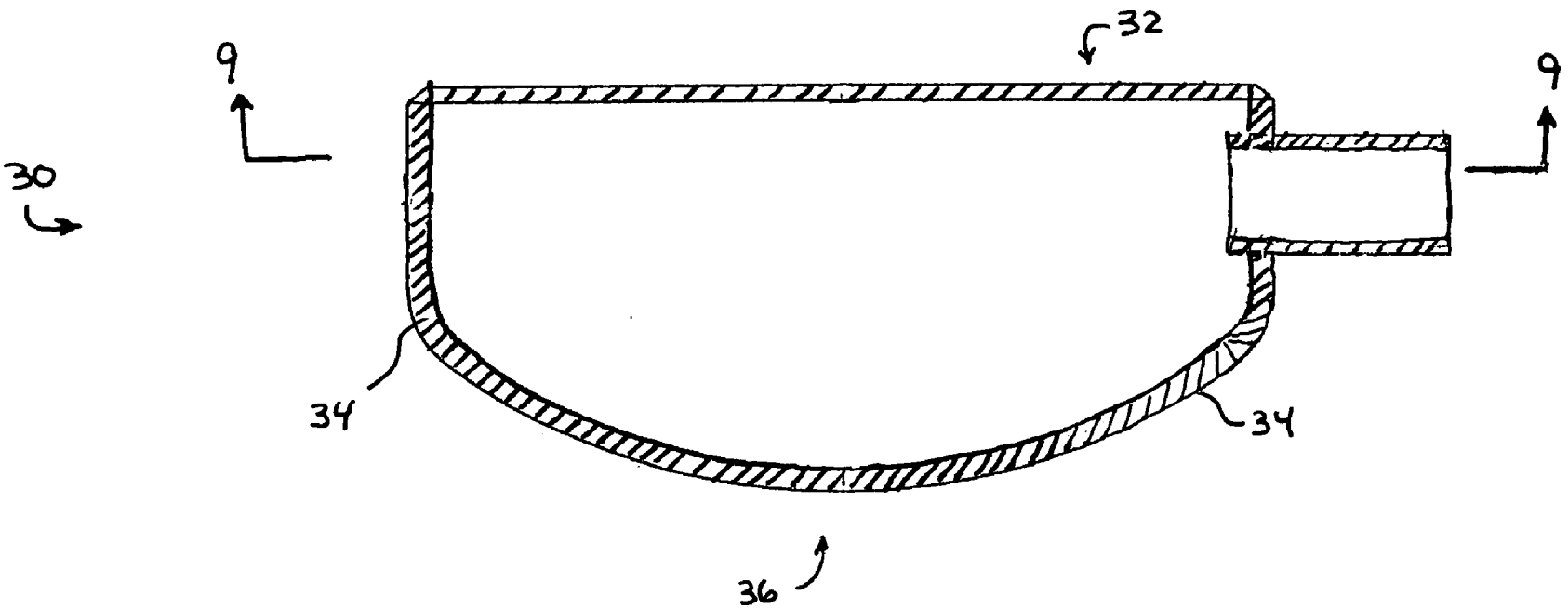
FIG. 8 is a vertical side cross-sectional view of a lower shell section in accordance with the present invention.

As shown in FIGS. 2–3, the upper shell section 20 preferably has a dome or bowl shaped closed end portion 27, and a substantially linear sidewall 24. In an alternative embodiment, the upper shell section 20 is substantially uniform-diameter cylinder having a substantially flat, plate-like closed end portion 27. Similarly, as shown in FIGS. 2 and 8, the lower shell section 30 preferably has an essentially dome or bowl shape closed end portion 36, and a substantially linear sidewall 34. The substantially linear sidewalls 24, 34 of the upper shell section 20 and lower shell section 30 each terminate in an opening 22, 32 suitable for hermetic connection to the middle shell section 40. The substantially cylindrical sidewalls 24, 34 of each section 20, 30 extend from the corresponding opening 22, 32, to the corresponding end portion 27, 36 disposed opposite the corresponding opening 22, 32. Preferably, the largest outer diameter of each sidewall 24, 34 is between about 10 to about 18 inches. More preferably, the outer diameter of each sidewall 24, 34 is between 12 and 16 inches. Most preferably, the diameter of each sidewall 24, 34 is between 13 and 15 inches.

Figure 5:
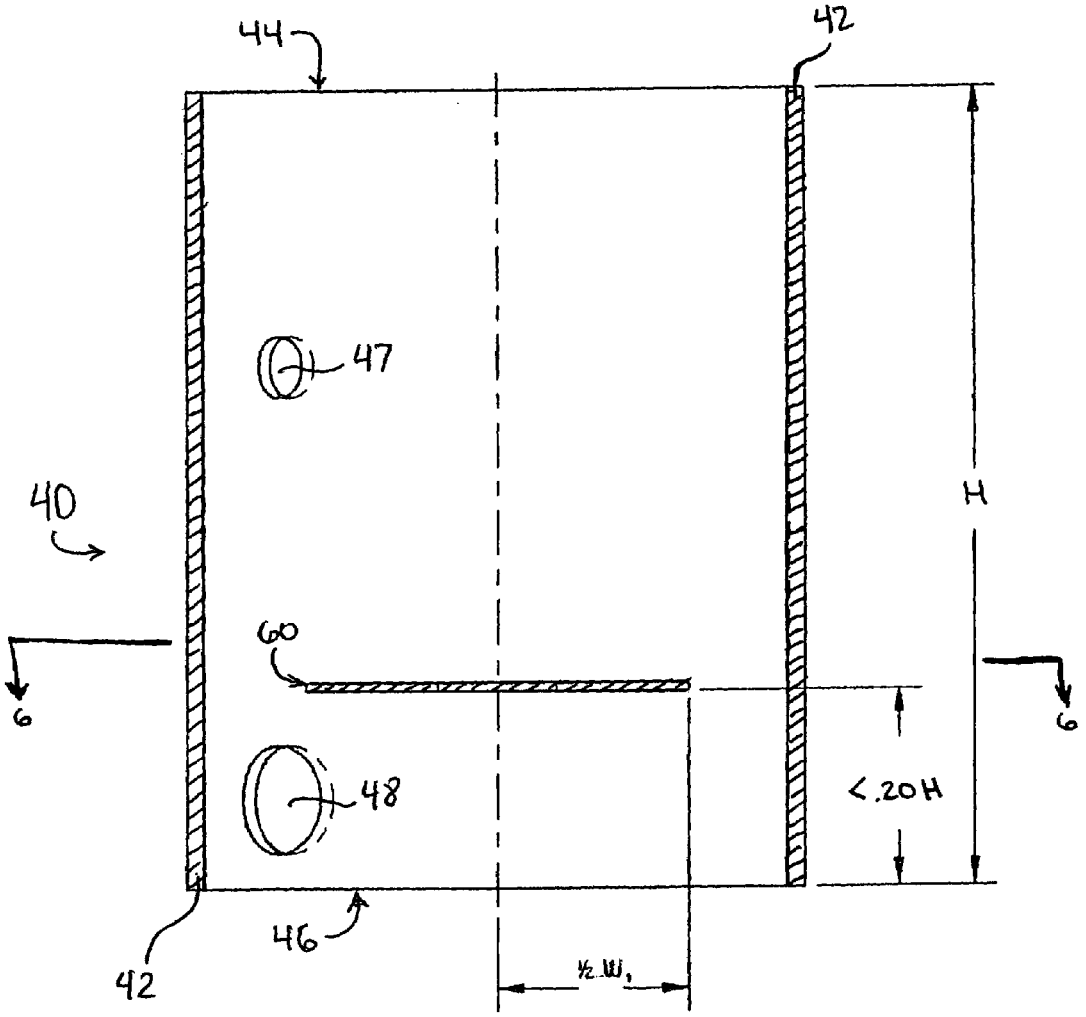
FIG. 5 is a vertical side cross-sectional view of a middle shell section of a flash tank economizer in accordance with the present invention.
Figure 6:
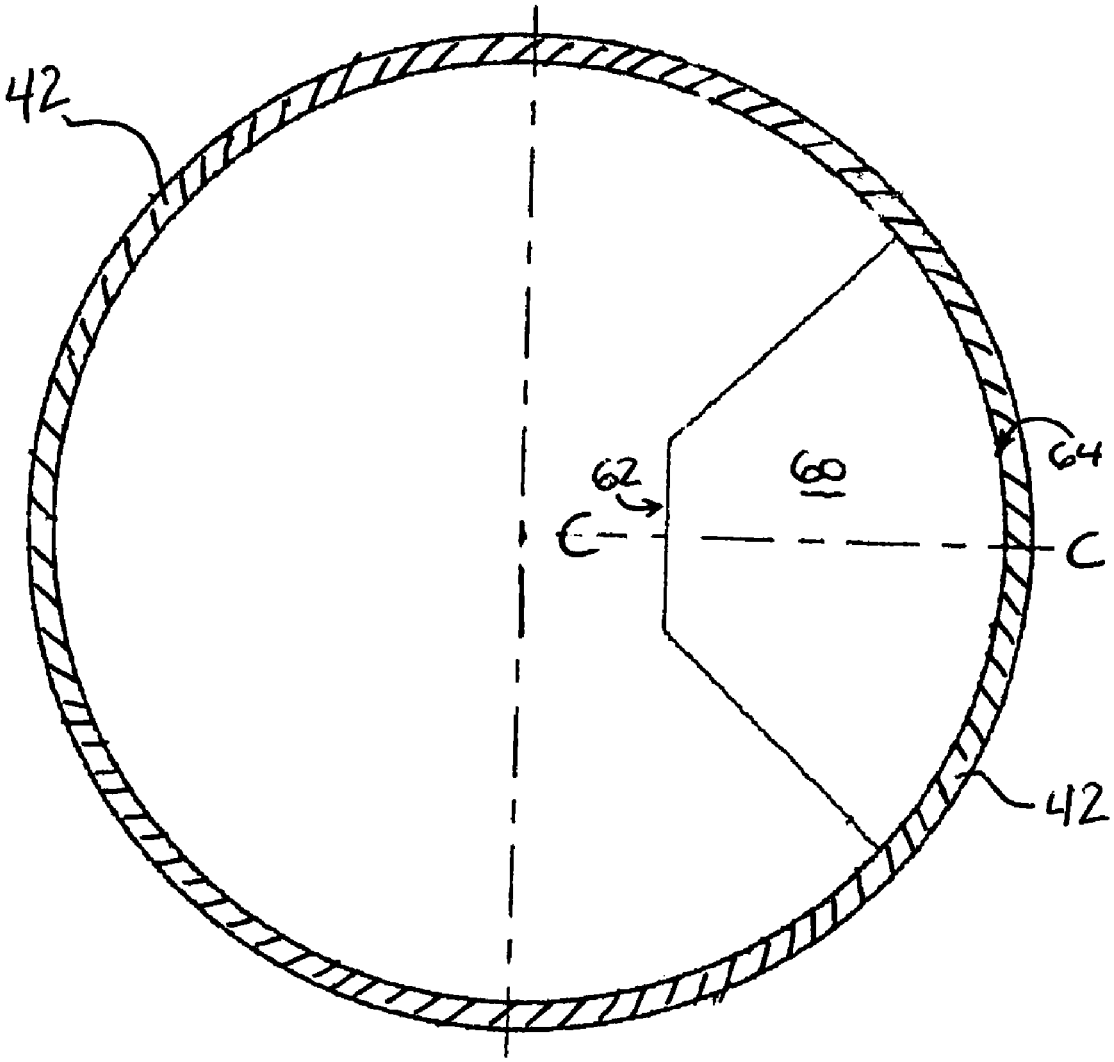
FIG. 6 is a horizontal top cross-sectional view of the middle shell section of FIG. 5 taken along section line 6—6.

As shown in FIGS. 2, 5, and 6, the middle shell section 40 has a substantially cylindrical shape formed by substantially cylindrical sidewall 42. The sidewall 42 terminates to form two opposed openings, an upper opening 44 and a lower opening 46. Preferably, the largest outer diameter of the sidewall 42 matches the largest outer diameter of the sidewalls 24, 34 and is between about 10 to about 18 inches. More preferably, the outer diameter of the sidewall 42 is between 12 and 16 inches. Most preferably, the outer diameter of the sidewall 42 is between 13 and 15 inches.

The upper opening 44 of the middle shell section is adapted to securely engage the opening 22 of the upper section 20, and the lower opening 46 is adapted for securely engaging the opening 32 of the lower section 30. In a preferred embodiment, each opening 22, 32 is adapted to nest or fit within the corresponding opening 44, 46 of the middle shell section 40. More preferably, the shell sections 20, 30, 40 are permanently and hermetically connected, such as by welding, to form the housing, although other suitable connection techniques can be used.

Figure 9:
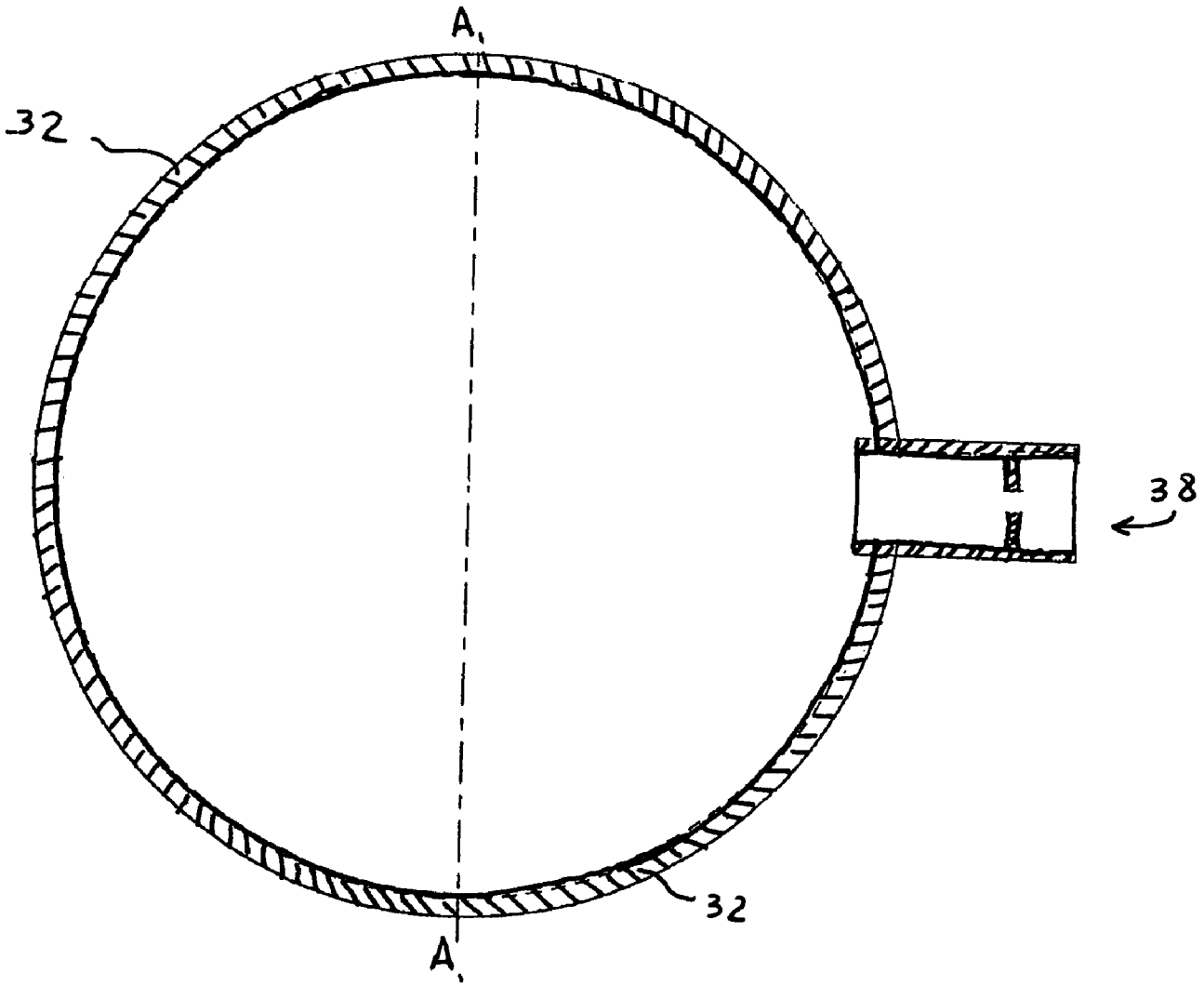
FIG. 9 is a horizontal top cross-sectional view of the lower shell section of FIG. 8 taken along section line 9—9.
Figure 10:
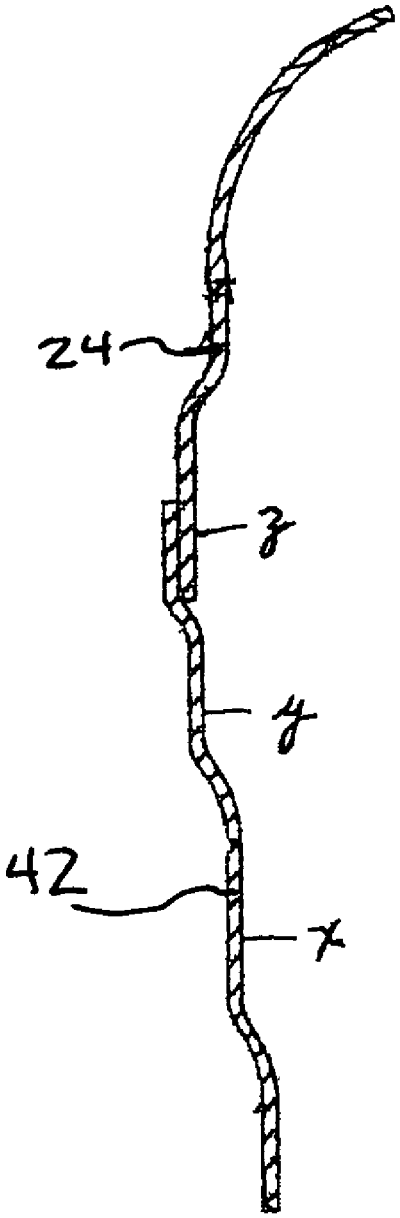
FIG. 10 is a cross-sectional view of one connection type for two adjacent shell sections in accordance with the present invention.
Figure 11:
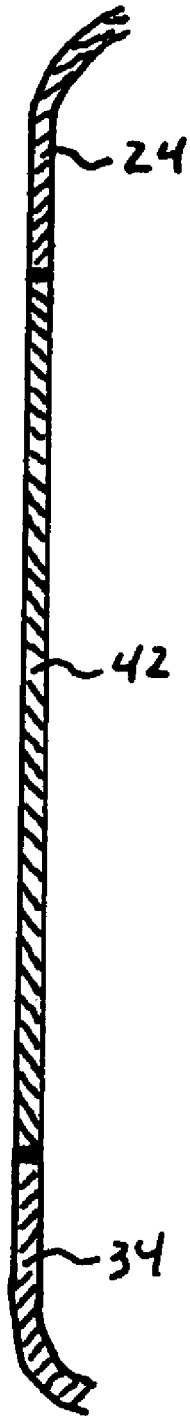
FIG. 11 is a cross-sectional view of another connection type for adjacent shell sections in accordance with the present invention.

As shown in FIGS. 3–6 and 8–9, the openings 22, 32, 44, 46 of each shell section 20, 30, 40 generally have a circular horizontal cross-sectional geometry, and are preferably compatible with the geometry of the openings of adjacent shell sections. For purposes of this application, circular, oval, and ovaloid shapes are all considered to be "generally circular." As previously described, the sidewalls 24, 34, 42 of each shell section 20, 30, 40 are preferably substantially straight or linear in an axial direction. The term "substantially straight" in this context permits a slight outward or inward bow on a substantially uniform radius should such a bow be desired at all. The origin of a slight outward bow may be located at any peripheral position around the sidewall of the shell section, such that the radius is used to define the curvature, if any, of the sidewall. The length of the radius can be "substantially uniform" which means that the radius length for different small segments of a sidewall section can be changed for some specific purpose such as spatial requirements, without thereby deviating from the concept of giving a slight bow to the sidewall. In another embodiment, the sidewall 24, 34, 42 of each shell section 20, 30, 40 may also be "stepped" inwardly or outwardly one or more times from the opening toward the opposite end thereof, i.e., progressively or by steps of decreased or increased diameters. For example, FIG. 10 illustrates the steps as x, y and z. This "stepped" shell wall concept is common for permitting the tank 110 to be fitted within limited space areas of a refrigeration system. Alternatively, as shown in FIG. 11, the shells may be joined, such as by welding, to form a smooth continuous sidewall construction of the assembled tank 110.

As shown in FIGS. 2–3, the upper shell section 20 further includes features that facilitate and enhance the performance of the economizer circuit. In particular, the end portion 27 of the upper shell section 20 includes a gas outlet 28 for conveying refrigerant gas to the compressor 102. Preferably, the gas outlet 28 is located at the horizontal and vertical cross-sectional geometric center of the end portion 27, whether the upper shell section 20 shell is configured as a dome, or alternatively as a substantially uniform-diameter cylinder having a substantially flat, plate-like closed end portion 27. More preferably, the end portion 27 is domed such that the cross-sectional geometric center of the end portion 27 forms the peak of the dome. Most preferably, the end portion 27 is domed such that the cross-sectional geometric center of the end portion 27 forms the peak of the dome, and the gas outlet 28 is provided as a circular aperture at the cross-sectional geometric center of the end portion 27 so that refrigerant gas rising from the tank 110 will enter the gas outlet 28 with minimal travel along the interior surface of the end portion 27. The gas outlet 28 may be provided as a simple uniform aperture through the wall of the end portion 27, or may include a decreasing diameter or stepped side cross-sectional profile, similar to the stepped wall configuration shown in FIG. 10. Such configurations are appropriate for conveying refrigerant gas to a compressor return line communicably connected to the gas outlet 28. Alternatively, the gas outlet 28 is provided as a substantially cylindrical pipe that preferably protrudes at least approximately 0.500 inches, and more preferably about 0.700 inches, into the tank 110 through the end portion 27. Additionally, the gas outlet 28 may include means for controlling gas flow through the outlet 28, such as a suction valve.

As further shown in FIGS. 2–3, the upper shell section 20 further includes a refrigerant inlet 26 for receiving refrigerant from the condenser 106, or from an expansion device 112 in the liquid line leading from the condenser 106 to the inlet 26. The refrigerant inlet 26 is located in the sidewall 24, preferably in the substantially linear vertical portion of the sidewall 24. Preferably, the inlet 26 is provided as an aperture in the sidewall 24, the aperture having a longitudinal axis that is substantially perpendicular to the substantially linear vertical sidewall 24. Preferably, the aperture is substantially circular or substantially cylindrical and is oriented so as to direct the stream of expanding refrigerant perpendicularly into a sidewall of a cylindrical baffle 50. Preferably, the longitudinal axis of the gas inlet 26 is substantially perpendicular to the longitudinal axis of the gas outlet 28.

An expansion device 112 is provided upstream of the inlet 200, whether installed in the liquid refrigerant line from the condensor 106 or immediately adjacent the gas inlet 26. Preferably, the expansion device 112 is an electronically controlled expansion valve whose port opening is regulated by a mechanical means such as an actuator or motor. The size of the expansion device 112 opening is controlled in response to a signal from a control that receives data from a number of different points in the system. The data is processed by a controller to determine the optimum setting of the expansion valve 112 and other valves in the refrigeration system to respond to existing operating conditions. The expansion valve 112 serves to rapidly expand the high-pressure liquid refrigerant to a lower intermediate pressure, preferably to approximately halfway between the condenser pressure and the evaporator pressure.

Figure 4:
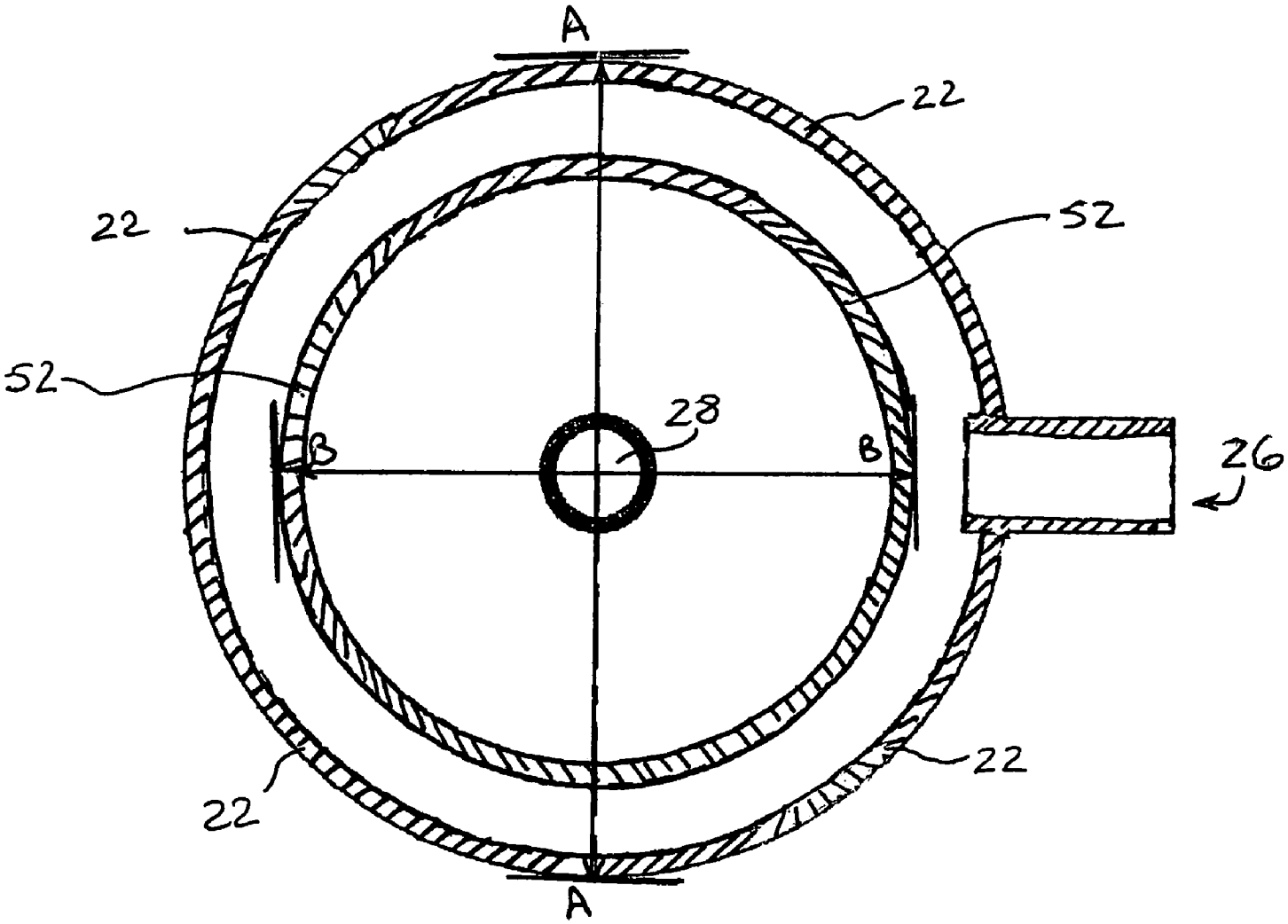
FIG. 4 is a horizontal top cross-sectional view of the upper shell section of FIG. 3 taken along section line 4—4.

As shown in FIGS. 2–4 and discussed briefly above, the flash tank 110 further includes a cylindrical baffle 50 that is disposed within the upper section 20 substantially concentric to the sidewall 24. The baffle 50 can also be partially disposed in the middle section 40. Preferably, the baffle 50 is substantially cylindrical in shape, and is comprised of a substantially cylindrical sidewall 52. As shown in FIG. 4, the diameter of the horizontal cross sectional geometry of the tank 110 is defined by diameter A—A, while the diameter of the horizontal cross sectional geometry of the baffle 50 is defined by diameter B—B. The comparative ratio of the respective diameters along these axes is the ratio of the dimensions $W_A$ and $W_B$. The ratio $W_A/W_B$ is preferably from about 1.2 to about 1.6. In the preferred embodiment, the sidewall shape of the tank 110 and baffle 50 substantially correspond, i.e. are substantially concentric, such that the sidewall 52 of the baffle 50 remains approximately equidistant from the sidewall 24 of the upper shell section 20 around the entire circumference of the baffle 50 along the axial length of the baffle 50.

The sidewall 52 of the baffle 50 terminates to form two opposed openings, an upper opening 54 and a lower opening 56. The upper opening 54 is preferably adapted to securely engage the interior surface of the end portion 26 of the upper shell section 20. The sidewall 52 is non-perforated, and has its upper end sealed against interior surface of the end portion 27 of the upper shell section 20 so that all gas must travel up through the lower opening 56 of the baffle 50 to reach the gas outlet 28. For example, the sidewall 52 adjacent the upper opening 54 can be welded, such as by a skip-weld to the interior surface of the end portion 27. This prevents any liquid refrigerant entering the inlet 26 from reaching the gas outlet 28.

The lower opening 56 of the baffle 50 is adapted to receive refrigerant, gas and remains substantially unencumbered by other tank 110 components. Preferably, the axial length of the sidewall 52 along axis C—C is greater than the length of the substantially linear sidewall 24, so that the lower opening 56 of the upper baffle 50 extends into the cavity formed by the middle shell section 40 of the assembled tank 10. Preferably, the axial length of the sidewall 52 is less than or equal to the largest horizontal cross sectional inner diameter of the substantially cylindrical upper baffle 50. More preferably, the axial length of the sidewall 52 axis is at least 20% but less than 100% of the largest horizontal cross sectional inner diameter of the substantially cylindrical baffle 50.

As shown in FIGS. 2, 5 and 6, the tank 110 further includes a second baffle 60 that works in conjunction with the cylindrical baffle 50 to promote expansion of the refrigerant liquid into a gas, efficient separation of the refrigerant gas and liquid, and reliable conveying of the refrigerant gas and the refrigerant liquid to their appropriate intended destinations within the refrigeration system. As refrigerant enters the tank 110 through the gas inlet 26, the refrigerant strikes the cylindrical baffle 50 and falls towards the bottom or lower section 30 of the tank 110. The liquid phase gathers in the bottom portion 30 of the tank to form a level of refrigerant liquid at an intermediate pressure that can be conveyed to the evaporator 108 through a liquid refrigerant outlet 38. However, as the refrigerant liquid falls from the gas inlet 26, it has a tendency to re-entrain in the gaseous refrigerant. The second, lower baffle 60 prevents excessive re-entrainment toward the lower section 30 of liquid refrigerant into the gaseous refrigerant. As shown in FIG. 2, the baffle 60 is provided at a preselected location on the interior surface of the sidewall 42 above a preselected maximum liquid level. Preferably, the baffle 60 is located on the interior sidewall of the middle section 40 of the tank 110. However, the exact location of the baffle 60 on the sidewall 42 is determined based upon a predetermined maximum liquid level, so that the lower baffle 60 is preferably never submerged in the liquid refrigerant in the tank.

Figure 7:
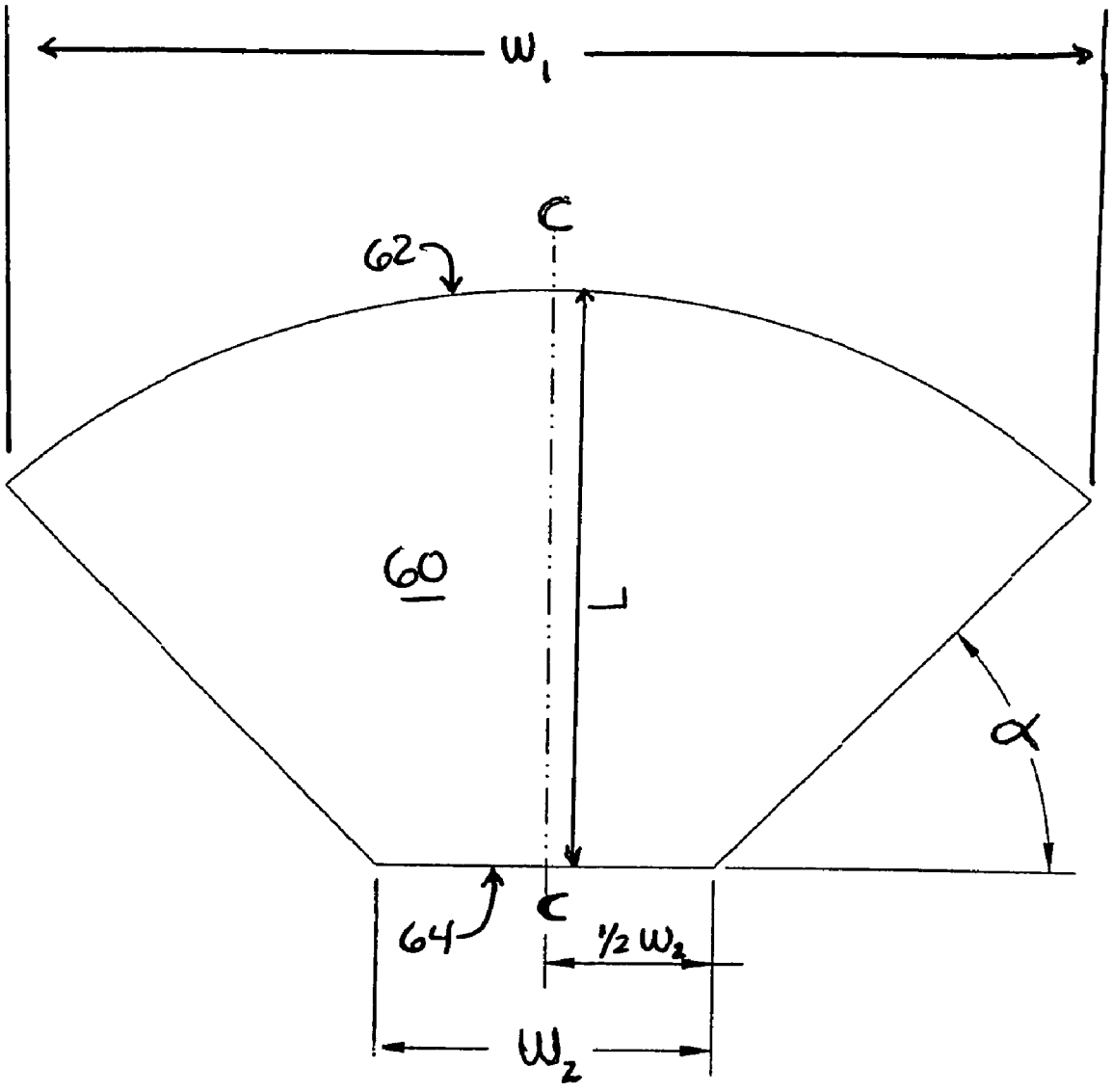
FIG. 7 is a top view of a lower baffle in accordance with the present invention.

As shown in FIGS. 5–7, the lower baffle 60 is preferably provided as a substantially flat piece of non-porous material, such as steel or plastic, that protrudes substantially perpendicularly from the sidewall 42 into the interior cavity of the tank 110. Preferably, the lower baffle 60 has a first end 62 that is shaped to permit continuous contact with the interior surface of the sidewall 42. For example, the first end 62 is preferably radiused to approximately match the radius of the sidewall 42. The lower baffle 60 has an opposite second end 64 that protrudes into the interior cavity of the tank 110.

Preferably, the baffle 60 is symmetric about a longitudinal central axis drawn from the midpoint or center of the first end 62 to the midpoint or center of the second end 64. Preferably, the central axis of the lower baffle 60 is circumferentially aligned with the refrigerant inlet 26, and is also aligned with the refrigerant liquid outlet 38.

The first end of the lower baffle 60 must be of sufficient width so as to prevent gas from being pulled into the liquid by the force of liquid exiting the liquid outlet 38. Preferably, the width of the first end 62, shown as $W_1$, is such that, when attached to the interior surface of the sidewall 42, the baffle 60 spans at least about 15 to about 150 degrees around the interior circumference of the substantially circular sidewall 42. More preferably, the width $W_1$ of the first end 62 is such that, when attached to the interior surface of the sidewall 42, the baffle spans between about 60 to about 120 degrees around the interior circumference of the substantially circular sidewall 42. Most preferably, the width $W_1$ of the first end 62 is such that, when attached to the interior surface of the sidewall 42 with the longitudinal axis of the baffle 60 aligned with the refrigerant inlet 26 and liquid outlet 38, the baffle spans between about 80 to about 100 degrees around the circumference of the interior surface of the substantially circular sidewall 42.

Similarly, the longitudinal central axis (C—C) of the lower baffle 60 is of sufficient length, L, such that the second end 64 protrudes over the liquid outlet 38 to prevent re-entrainment of gas or escape of gas through the liquid outlet 38. The length L of the baffle 60 along the longitudinal central horizontal central axis (C—C) should be at least 20% but less than 100% of the largest horizontal cross-sectional inner diameter of the substantially cylindrical section of the sidewall 42 to which the first end 62 is secured. More preferably, the length L along longitudinal axis C—C is between about 20% to about 50% of the largest horizontal cross-sectional inner diameter of the substantially cylindrical section of the sidewall 42 to which the first end 62 is secured. Preferably, the second end 64 is provided as a substantially linear edge aligned substantially perpendicular to the longitudinal axis C—C of the baffle 60. The second end 64 has a width, shown as $W_2$ in FIG. 7, that is proportional to the length L, preferably in the range of between about 0.25:1 to about 4:1. More preferably, the ratio is between about 1:1 to about 3:1. Additionally, the ratio of $W_1$ to $W_2$ is between about 1:1 to about 4:1, and is preferably between about 2:1 and about 3:1. The first end 62 and second end 64 are joined by side edges 66. Preferably, the side edges 66 are substantially linear, and meet the second edge 64 at an angle $\alpha$. More preferably, the angle $\alpha$ is between about 30 to about 50 degrees.

The level of the liquid in the lower portion 30 of the tank 110 is governed by several features. First, as previously described, a liquid outlet 38 is provided in the lower shell section 30 for conveying refrigerant liquid from the tank 110 to the evaporator. Preferably, as shown in FIGS. 8–9, the liquid outlet 38 is substantially cylindrical, and is located at a point in the bottom 20% of the tank as measured using the total height, H, of the assembled tank 10. The outlet 38 may include means such as valves to permit regulation of the rate and volume of liquid refrigerant conveyed to the evaporator from the tank 110.

Additionally, the invention provides a level control apparatus 70 that regulates the liquid level. Preferably, the level control apparatus 70 maintains a substantially constant level of liquid in the tank, thereby preventing gas from entering the liquid outlet 38, and ensuring that liquid does not reach the gas outlet 28 to avoid damage to the compressor. As shown in FIG. 2, in one embodiment, the level control apparatus 70 is comprised of a tube-like structure mounted through the sidewall 42 to communicably connect a bottom region of the tank 110 beneath the maximum liquid level with a region of the tank 110 above the maximum liquid level. The level control apparatus 70 is a substantially cylindrical tube-like structure having two opposite ends 72, 74, joined by a central passage 76. Preferably, the inner diameter of the tube-like section of the apparatus 70, as well as the diameter of the ends 72, 74 is at least 0.5 inches in order to prevent thermal isolation of the level column in the apparatus 70, and to promote rapid response in the column to a change in the level of liquid refrigerant in the tank. Each end has an opening 78 for communicably connecting two regions of the interior of the tank 110. The apparatus includes a first lower end 72 for connection to a first liquid level opening 48 provided in the sidewall 42 beneath the maximum liquid level, and an opposite second upper end 74 for connection to a second opening 47 provided in the sidewall 42. The level control apparatus 70 also includes a level detector/sensor (not shown) that can be connected to a refrigeration system control, such as a control microprocessor, to communicate data concerning the liquid level in the level control apparatus 70, whereupon the microprocessor can operate valves in the system or otherwise adjust system operating parameters to adjust and control the liquid level in the tank 110.

The fully assembled economizer flash tank of the present invention operates as follows. First, liquid refrigerant collected in the condenser 106 is passed through a liquid line to the refrigerant inlet 26 of the flash tank 110. Upon exiting the inlet 26, the liquid refrigerant is throttled or expanded within the flash tank 110 to a desired temperature and pressure. Upon entering the flash tank 110 through the inlet 26, the expanded refrigerant is immediately directed against the cylindrical baffle 50, resulting in turbulent flow that lowers the temperature and pressure of the refrigerant. The turbulent refrigerant flow falls towards the bottom portion 30 of the tank 110. As the refrigerant falls, the gaseous refrigerant is separated from the liquid refrigerant by the forces of gravity, and also by the force of turbulence created by the cylindrical baffle 50. The liquid refrigerant is collected in the bottom portion 30 of the tank 110, while the gas or vapor phase is collected in the domed shaped upper section 20 of the tank 110. The gas collected in the upper portion 20 is then passed through the gas outlet 28 and back to the compressor by means of a return line. Prior to being injected into the compressor 102, the gas may optionally be passed through the compressor motor 104 to provide additional cooling to the motor 104. Preferably, the gas is injected into the compression chamber downstream from the compressor inlet at a point where the pressure in the chamber is about equal to the intermediate pressure maintained inside the economizer tank 110.

The liquid refrigerant in the tank 110 falls onto the lower baffle 60 located above the liquid level, and then trickles into the liquid level. The lower baffle 60 thus prevents direct contact and mixing between the liquid level and the falling liquid refrigerant, thereby minimizing entrainment of gaseous refrigerant into the liquid level. Liquid refrigerant collected in the liquid level is pulled through the liquid outlet 38 where it undergoes a second expansion, such as by an expansion valve before entering the evaporator 108, which expansion reduces the pressure and temperature of the liquid phase down to that of the evaporator 108. The flow of liquid through the outlet 38 can be controlled by valve means such as valves that vary the size of the opening of the outlet 38 and thus meter the flow of refrigerant into main flow line 107 leading to the evaporator 108.

Capacity added by the economizer circuit can be controlled by modulating the refrigerant inlet 26, the liquid outlet 38, and the gas outlet 28. Additionally, the level of liquid in the tank 110 can be adjusted by sensing using the level control apparatus 70 and processing the sensed data to instruct a control to open and close valves at the gas inlet 26 and refrigerant outlets 38, 28 to maintain a relatively constant liquid level in the flash tank.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not limited to the particular embodiment disclosed as the best mode contemplated for carrying out this invention, but that the invention will include all embodiments falling within the scope of the appended claims.

What is claimed is:

1. A flash tank for use in an economizer circuit, the flash tank comprising:

a housing having a closed end portion and a substantially cylindrical shape with substantially cylindrical sidewalls, the housing comprising:

an upper shell section having a substantially cylindrical sidewall and a closed end portion;

a middle shell section disposed adjacent to the upper shell section and having a substantially cylindrical sidewall; and a lower shell section disposed adjacent the middle section and having a substantially cylindrical sidewall and a closed end portion, each shell section having an opening for connection to the adjacent shell section;

a refrigerant inlet located in the sidewall of the upper shell section;

a substantially cylindrical baffle having a sidewall disposed at least partially in the upper shell section and substantially parallel to the sidewall of the upper section, the baffle sidewall being configured to direct the flow of high-pressure refrigerant introduced into the housing through the refrigerant inlet;

a gas outlet disposed in the closed end portion of the upper shell section;

a second baffle located on the interior side of the sidewall of the middle section; and a liquid refrigerant outlet disposed in the sidewall of the lower shell section for conveying liquid refrigerant from the housing to another component in a refrigeration system.

2. The flash tank of claim 1, wherein the cylindrical baffle has a first end connected an interior surface of the closed end portion of the upper shell section, and a second end opposite the first end having an opening for communicably connecting the gas outlet to the middle shell section.

3. The flash tank of claim 1, wherein the cylindrical baffle is disposed substantially concentric to the sidewall of the upper shell section.

4. The flash tank of claim 1, wherein the length of the sidewall of the cylindrical baffle is at least 20% but less than 100% of a horizontal cross sectional inner diameter of the cylindrical baffle.

5. The flash tank of claim 1, wherein the refrigerant inlet includes a substantially cylindrical aperture having a longitudinal axis that is substantially perpendicular to the sidewall of the cylindrical baffle.

6. The flash tank of claim 1, wherein the refrigeration inlet and the liquid refrigerant outlet are substantially circumferentially aligned on the sidewall of the housing.

7. The flash tank of claim 1, wherein the second baffle is comprised of a substantially flat piece of non-porous material.

8. The flash tank of claim 1, wherein the second baffle includes a first end and an opposite second end, and wherein the first end is attached to the interior surface of the sidewall of the housing at a point above a preselected maximum liquid level.

9. The flash tank of claim 8, wherein the first end of the second baffle is shaped so as to permit continuous contact with the interior surface of the sidewall of the housing.

10. The flash tank of claim 8, wherein the first end of the second baffle is of sufficient width so as to span between about 50 and about 150 degrees around the circumference of the interior surface of the sidewall.

11. The flash tank of claim 8, wherein the second baffle is substantially symmetric along a central axis connecting the midpoints of the first end and the second end of the second baffle.

12. The flash tank of claim 11, wherein the central axis is substantially circumferentially aligned with the refrigeration inlet and the liquid refrigerant outlet on the sidewall of the housing.

13. The flash tank of claim 8, wherein the opposite second end of the second baffle protrudes substantially perpendicularly from the sidewall into an interior cavity of the housing.

14. The flash tank of claim 8, wherein the length of the second baffle along the central axis is between 20% and 50% of the largest horizontal cross-sectional diameter of the housing sidewall to which the first end of the second baffle is attached.

15. The flash tank of claim 8, wherein the ratio of the width of the first end to the width of the second end is between about 2:1 and about 4:1.

16. The flash tank of claim 8, wherein the width of the second end is less than the width of the first end, and wherein the ends are connected by substantially linear side edges.

17. The flash tank of claim 8, wherein the second end is substantially linear and is aligned substantially perpendicular to the central axis.

18. The flash tank of claim 8, wherein the ratio of the width of the second end to the length of the second baffle along the central axis is between 0.5:1 and 3:1.

19. The flash tank of claim 8, wherein the liquid level control apparatus mounted through the sidewall has a substantially cylindrical interior having a substantially uniform inner diameter.

20. The flash tank of claim 19, wherein the inner diameter of the liquid level control apparatus is at least 0.5 inches.

21. A method of separating liquid refrigerant from refrigerant gas in an economizer refrigeration system, the method comprising the steps of:

providing a refrigeration system equipped with an economizer circuit, the economizer circuit including a flash tank having housing comprising a refrigerant inlet, a refrigerant gas outlet, a liquid refrigerant outlet, a cylindrical baffle, and a second baffle;

collecting liquid refrigerant in a condenser of the refrigeration system;

passing the liquid refrigerant from the condenser to a liquid refrigerant line of the economizer circuit, the refrigerant line having an expansion device therein and communicably connected to the refrigerant inlet of a flash tank;

receiving expanding refrigerant from the liquid line into the refrigerant inlet;

directing the flow of received refrigerant against the cylindrical baffle of the flash tank, the cylindrical baffle disposed substantially adjacent the refrigerant inlet;

separating the gas phase of the liquid refrigerant from the liquid phase of the refrigerant; and preventing re-entrainment of refrigerant gas by providing a second baffle located on the sidewall of the housing at a point above a preselected maximum liquid level.

22. The method of claim 21, further comprised of the step of maintaining a constant level of refrigerant liquid in the flash tank by conveying the refrigerant gas through the interior of the cylindrical baffle to the gas outlet, and by conveying refrigerant liquid to a main refrigerant line through the liquid refrigerant outlet.

23. A refrigeration system comprising a compressor, a condenser, and an evaporator interconnected to form a closed refrigeration circuit, the closed refrigeration circuit further comprising an economizer circuit including a flash tank, the flash tank comprising:

a housing having a closed end portion and a substantially cylindrical shape with substantially cylindrical sidewalls, the housing comprising:

an upper shell section having a substantially cylindrical sidewall and a closed end portion;

a middle shell section disposed adjacent to the upper shell section and having a substantially cylindrical sidewall; and a lower shell section disposed adjacent the middle section and having a substantially cylindrical sidewall and a closed end portion, each shell section having an opening for connection to the adjacent shell section;

a refrigerant inlet located in the sidewall of the upper shell section;

a substantially cylindrical baffle having a sidewall disposed at least partially in the upper shell section and substantially parallel to the sidewall of the upper section, the baffle sidewall being configured to direct the flow of high-pressure refrigerant introduced into the housing through the refrigeration inlet;

a gas outlet disposed in the closed end portion of the upper shell section;

a second baffle located on the interior side of the sidewall of the middle section; and a liquid refrigerant outlet disposed in the sidewall of the lower shell section for conveying liquid refrigerant from the housing to another component in a refrigeration system.

24. The refrigeration system of claim 23, wherein the refrigerant inlet and the liquid refrigerant outlet are substantially circumferentially aligned on the sidewall of the housing.

25. The refrigeration system of claim 24, wherein the second baffle is comprised of a substantially flat piece of non-porous material.

26. The refrigeration system of claim 25, wherein the second baffle includes a first end and an opposite second end, and wherein the first end is attached to the interior surface of the sidewall of the housing at a point above a preselected maximum liquid level.

27. The flash tank of claim 26, wherein the first end of the second baffle is of sufficient width so as to span between about 50 and about 150 degrees around the circumference of the interior surface of the sidewall.

* * * * *

UNITED STATES PATENT AND TRADEMARK OFFICE

CERTIFICATE OF CORRECTION

PATENT NO. : 6,941,769 B1
DATED : September 13, 2005
INVENTOR(S) : Hill, IV et al.

It is certified that error appears in the above-identified patent and that said Letters Patent is hereby corrected as shown below:

Column 14,
Line 24, "system of claim 24" should be -- system of claim 23 --.

Signed and Sealed this

Seventeenth Day of January, 2006

JON W. DUDAS
*Director of the United States Patent and Trademark Office*